United States Patent [19]

Allison

[11] Patent Number: 4,870,919

[45] Date of Patent: Oct. 3, 1989

[54] CATAMARAN TYPE BOAT

[76] Inventor: Bill W. Allison, 3603 Rychlik, Rosenburg, Tex. 77471

[21] Appl. No.: 197,215

[22] Filed: May 23, 1988

[51] Int. Cl.[4] ..... B63B 1/20

[52] U.S. Cl. ..... 114/61; 114/356

[58] Field of Search ..... 114/61, 356, 288, 292, 114/283, 679, 291, 355

[56] References Cited

U.S. PATENT DOCUMENTS

| | | | |
|---|---|---|---|
| 1,677,495 | 7/1928 | Schmitt | 114/288 |
| 2,373,019 | 4/1945 | Dix | 114/288 |
| 2,666,406 | 1/1954 | Babcock | 114/288 |
| 2,900,945 | 8/1959 | Canazzi | 114/288 |
| 2,975,747 | 3/1961 | Opie | 114/61 |
| 3,307,511 | 3/1967 | Chapman | 114/61 |
| 3,937,164 | 2/1976 | Austin | 114/288 |
| 3,996,871 | 12/1976 | Boismard | 114/61 |

*Primary Examiner*—Joseph F. Peters, Jr.
*Assistant Examiner*—Edwin L. Swinehart
*Attorney, Agent, or Firm*—Hubbard, Thurman, Turner & Tucker

[57] ABSTRACT

A catamaran boat comprises two pontoons which are rigidly interconnected in laterally spaced relationship by a plurality of transverse beams. An air guiding sheet is rigidly connected to the bottom surfaces of the transverse beams and defines an air tunnel extending above the water between the two pontoons. The air guiding sheet is upwardly curved at its forward end and is provided with one or more transversely extending downwardly projecting ribs or bulges which result in a compression of the air in the tunnel when the boat is moving through the water. This substantially increases the lift exerted on the boat, permitting it to ride at a higher level and achieve higher speeds. The inner vertically extending walls of the spaced pontoons are disposed at an angle to the vertical, with each inner wall extending outwardly toward the outer wall by a slight angle. This configuration permits the boat to traverse shallower waters than has been heretofore possible with catamaran type boats.

11 Claims, 1 Drawing Sheet

CATAMARAN TYPE BOAT

BACKGROUND OF THE INVENTION

1. FIELD OF THE INVENTION

The invention relates to an improved hull structure for a catamaran type boat employing two laterally spaced, rigidly interconnected pontoons which support the boat on the surface of the water.

2. SUMMARY OF THE PRIOR ART

Catamaran type boats have long been known in the prior art. There are two recognized advantages of such boats. In the first place, when the boats are propelled at relatively high speed through the water, the upwardly flaring shape of the forward portions of the bottom surfaces of the two pontoons create a lifting effect which permits the boat hull to glide over the surface of the water, thus minimizing the frictional drag on the boat. Additionally, since neither hull normally strikes a wave at the same instant, the pitching of the boat produced by wave impact is significantly reduced.

In adapting the catamaran type boat hull to boats employed for sportsmen, and particularly fishermen, there are two desired characteristics. First, the boat should be capable of achieving a high speed so that the fisherman does not spend a good part of the day running from port to the fishing grounds. Secondly, many of the best sport fishing grounds comprise relatively shallow marsh waters, hence it is essential that the catamaran type boat have a very shallow draft and permit the boat to safely traverse water depths as low as three or four inches.

The prior art has not provided a catamaran type boat hull capable of accomplishing both of these objectives.

SUMMARY OF THE INVENTION

The catamaran type boat hull embodying this invention comprises a pair of hollow metallic pontoons which are secured in laterally spaced relationship by a plurality of transversely extending, longitudinally spaced beams which are welded to the top walls of the pontoons. Each of the pontoons is provided with a substantially flat water engaging surface which is curved upwardly at its forward end and is concurrently transversely tapered to a point configuration. An air guiding sheet is rigidly secured to the bottom surfaces of the transverse connecting beams. The forward end of such air guiding surface is curved upwardly in a configuration corresponding generally to the upward curve of the forward ends of the pontoons. Due to the narrowering of the front end of the pontoons, the air guiding surface is correspondingly enlarged. As a result, when the catamaran is propelled through the water at a significant speed, either by a motor or by a sail, the air guiding surface functions as a ram tunnel which compresses the air between itself and the water surface. Such compressed air thus effects a substantial lift to the boat hull, permitting the pontoons to ride at a higher level and thus diminish frictional drag of the water.

Additionally, the air guiding surface is provided with one or more transversely extending, downwardly projecting ribs or bulges which has the effect of creating turbulence in the air entering the air tunnel, thus further contributing to the lift effect for the same reason that the turbulent air beneath the wing of an airplane creates a lifting force.

Still another feature of this invention is the provision of a mounting for an outboard motor between the two pontoons but at a space located forwardly of the rear ends of such pontoons so that the propeller is engaging substantially undisturbed water and at least water that has not been ariated by the passage of the pontoons therethrough. This contributes greatly to the effective thrust developed by the outboard motor and permits greater speeds to be obtained.

Still another feature of this invention lies in the configuration of the inner walls of the two pontoons. While each inner wall extends in a generally vertical direction, such inner walls are deliberately inclined at a small angle toward the outer walls of the respective pontoon. Such inclination has been found to substantially assist the traverse of the catamaran type boat hull embodying this invention through shallow waters, since this inclination tends to trap the water within the air tunnel and provide additional lift as it flows out of the air tunnel when the pontoons enter extremely shallow water.

Further objects and advantages of the invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 1:
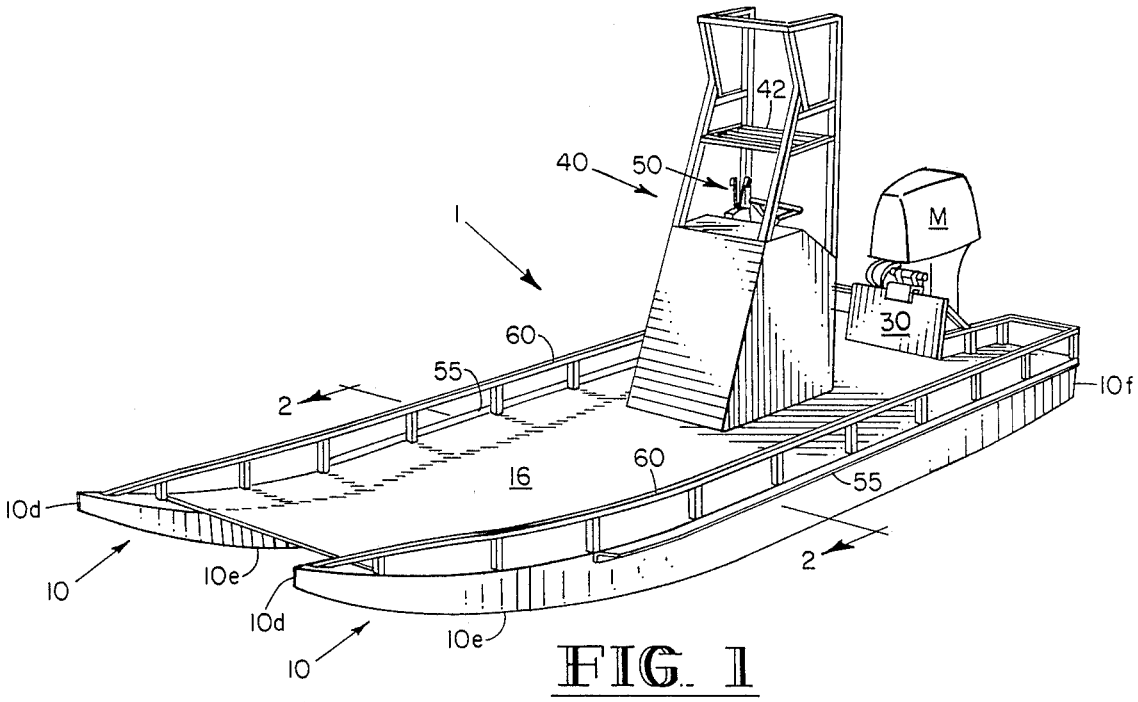
FIG. 1 is a perspective view of a complete catamaran type boat embodying this invention.

Referring to FIG. 1, the numeral 1 indicates generally a catamaran type boat, primarily designed for sportsmen, emboding this invention. Boat 1 includes a pair of substantially identical longitudinally extending pontoons 10 which are rigidly interconnected at a plurality of longitudinally spaced intervals by transversely extending beams or trusses 11 which are welded to the outer walls **10*a* of the pontoons and also to longitudinally extending beams 12 to provide a rigid frame work for supporting a top deck sheet 16, which is welded to the top surface of the outer walls 10*a* of pontoons 10**.

Figure 3:
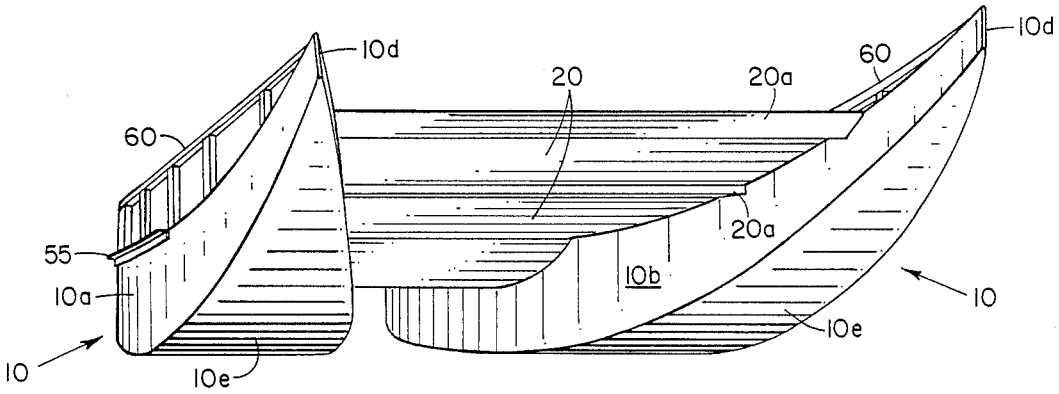
FIG. 3 is a perspective view of the forward portions of the catamaran type boat hull shown in FIG. 1.

A second series of transversely extending, longitudinally spaced beam or truss elements 14 are welded to the side walls of each of the pontoons 10 to provide additional lateral stability and also to provide a welded mounting for an air deflecting plate 20 which is best shown in FIG. 3. Additionally, longitudinally extending hollow beams 22 are welded to the bottom surface **10*c* of each of the pontoons 10** to provide for longitudinal stability.

As best shown in FIG. 3, the forward ends of each of the pontoons 10 are tapered to a line **10*d* and concurrently define an upwardly curved portion 10*e* on each of the bottom walls 10*c* of the pontoons 10**.

The air deflecting wall 20 thus fills all of the transverse space between the laterally separated pontoons 10 and hence is substantially wider at its forward end than at its rearward end. Additionally, the air deflecting surface 20 is upwardly inclined at its forward end conforming generally to the configuration of the bottom surface **10*c* of the pontoons but is provided at longitudinally spaced intervals with laterally extending, downwardly projecting ribs or bulges 20*a***. The effect of such ridges or bulges will be hereinafter described.

The rearmost transverse beams 12 and 14 interconnecting the two pontoons 10 are located forwardly of the rear ends 10*f* on pontoons 10 and employed to support a motor mounting plate or transom 30 to which an outboard motor M may be conventionally applied. It should be noted that the position of the outboard motor M is forwardly of the rear ends 10*f* of the pair of pontoons 10 (FIGS. 1 and 4), thus assuring that the propeller of the motor is operating in water that is substantially undisturbed and non-ariated due to the passage of the pontoons therethrough.

Forwardly of the motor mounting transom 30, an operators bridge or station 40 may be provided on which the conventional steering and motor controls 50 are mounted. Such operator station may include an elevated bridge deck 42 to permit the operator to better observe the surrounding waters when searching for the presence of game fish. A railing 60 may be provided around the outer extremities of the deck 16. Additionally, if desired, an anti-splash guard 55 may be welded to the top ends 10*a* of the outer pontoon side walls 10*b*.

All of the hull is preferably fabricated from aluminum or a light weight aluminum alloy. To insure non-sinkability in the event that one or both of the pontoons develops a leak, the interiors of pontoons 10 are filled with sufficient foamed plastic P to insure buoyance of the boat.

In operation, when the aforedescribed catamaran type boat hull is propelled through the water at a significant speed either by the motor M or by a sail (not shown) mounted on an appropriate mast, the upward configuration of the forward portions of the bottom surface 10*c* of the pontoons coupled with the water resistance effect an elevation of such forward ends so that the angular air tunnel defined by the air plate 20 becomes more acute and in effect produces a compression or ram effect on the air entering the tunnel defined between the inner side walls 10*b* of the pontoons 10 and the surface of the air guiding plate 20. This compression is further augmented by the transversely extending ridges or bulges 20*a* which create a degree of turbulence to such air, thus resulting in an upward force being exerted on the air guiding surface 20 which effects the elevation of the entire hull structure so that a minimal portion of the pontoons are in frictional engagement with the water surface. This feature, coupled with the specific mounting of the motor M so that the propeller (not shown) is operating on substantially, undisturbed, unariated water, provides a significant increase in speed of a catamaran type boat embodying this invention for the same size motor horse power over any conventional catamaran hull construction.

Figure 2:
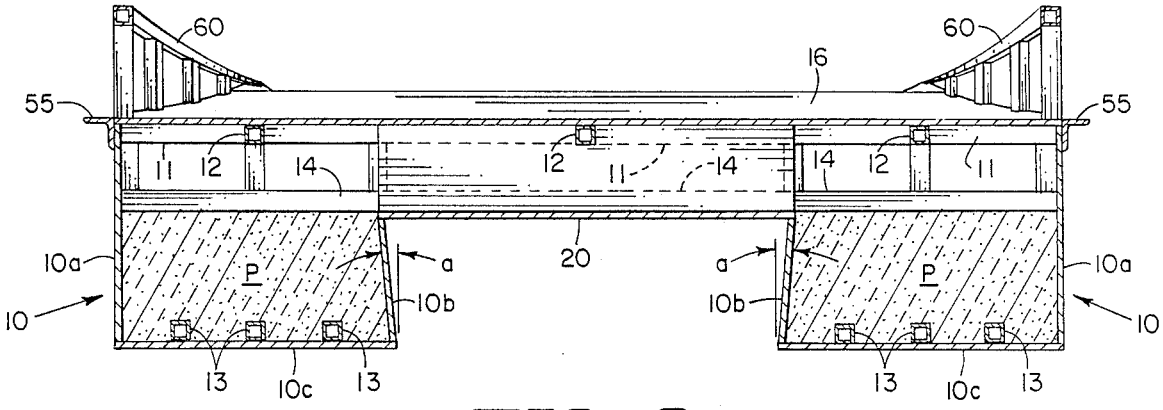
FIG. 2 is a sectional view taken on the plane 2—2 of FIG. 1.

Additionally, the catamaran type hull embodying this invention has shown the capability of being able to traverse very shallow depths of water on the order of three to four inches depending, of course, on the size of the craft, the weight carried, and the weight of the motor M. The reason for this is not really known to Applicant, but is believed to be caused by the outward inclination of each of the inner vertical wall surfaces 10*b* of the pontoons 10 indicated by the angle a in FIG. 2.

Such inclination is preferably in the range of 1 to 5° and an inclination of 1.5° in particular has been shown to provide this increased flotation in shallow waters. Perhaps the reason for the increased flotation is that this angle of inclination traps the water between the pontoons and, as the trapped water escapes laterally from the pontoons, additional flotation is imparted to the pontoons. In any event, the effect has been clearly demonstrated in the operation of this type of catmaran hull construction.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

I claim:

1. A catamaran type boat comprising:

a pair of elongated hollow floats;

a plurality of transversely disposed truss means rigidly connecting said floats in spaced parallel relationship;

the rearmost truss means being located forward of the rear ends of said hollow floats;

a first wall secured to the bottom surfaces of said truss means and positioned above the water level when said floats are engaged therewith, thereby defining a longitudinally extending air tunnel extending to the rearmost truss means;

each said float having a quadrilateral cross-section throughout its length including:

(1) a second wall defining a smooth planing surface curved upwardly and laterally tapered at its forward end;

(2) a generally vertical outer wall, and (3) an upstanding inner wall inclined upwardly and outwardly toward said generally vertical outer wall, thereby retaining water in said tunnel when said floats traverse shallow water.

2. The boat of claim 1 further comprising a motor mounting transom disposed rearwardly of said first wall and secured to said rearmost truss means at a position sufficiently forward of the rear ends of said floats to position an outboard motor forwardly of the rear ends of said floats.

3. The boat hull of claim 2 wherein said outward inclination of said inner walls of said floats to the vertical is about 1.5°.

4. The boat of claim 1 further comprising foam plastic filling the portions of said floats below said truss means.

5. The boat of claim 1 wherein said outward inclination of said inner walls of said floats to the vertical lies in the range of 1° to 5°.

6. A catamaran type boat comprising a pair of elongated hollow floats; a plurality of tranversely disposed truss means rigidly connecting said floats in spaced parallel relationship; a first wall secured to the bottom surfaces of said truss means and positioned above the water level when said floats are engaged therewith, thereby defining a longitudinally extending air tunnel extending to the rearmost truss means; the forward portion of said wall being upwardly curved and defining transversely extending downwardly projecting ridges, whereby rapid movement of the boat over water produces a turbulent compression of air in said air tunnel producing a lifting force on said wall.

7. The boat of claim 6 wherein each said float having a quadrilateral cross-section throughout its length including:

(1) a second wall defining a smooth planing surface curved upwardly and laterally tapered at its forward end, (2) a generally vertical outer wall, and (3) an upstanding inner wall inclined upwardly and outwardly toward said generally vertical outer wall, thereby retaining water in said tunnel when said floats traverse shallow water.

8. The boat of claim 7 further comprising a motor mounting transom disposed rearwardly of said first wall and secured to said floats at a position sufficiently forward of the rear ends of said floats to position an outboard motor forwardly of the rear ends of said floats.

9. The boat of claim 7 further comprising foam plastic filling the portions of said floats below said truss means.

10. The boat hull of claim 7 wherein said outward inclination of said inner walls of said floats to the vertical lies in the range of 1° to 5°.

11. The boat hull of claim 10 wherein said outward inclination of said inner walls of said floats to the vertical is about 1.5°.

* * * * *